United States Patent [19]

Skillern

[11] Patent Number: 4,658,455

[45] Date of Patent: Apr. 21, 1987

[54] MULTIPURPOSE TOOL

[75] Inventor: Robert M. Skillern, Lake Cormorant, Miss.

[73] Assignee: Lid-Claw Inc., Memphis, Tenn.

[21] Appl. No.: 853,222

[22] Filed: Apr. 17, 1986

[51] Int. Cl.[4] ..... B25F 1/00

[52] U.S. Cl. ..... 7/105; 7/151; 248/211

[58] Field of Search ..... 7/105, 151; 294/2, 12; 248/211, 318, 311.2; 15/105, 236 R; D8/40, 105

[56] References Cited

U.S. PATENT DOCUMENTS

| | | | |
|---|---|---|---|
| 1,676,648 | 7/1928 | Hardman | 81/3.57 |
| 2,652,278 | 9/1953 | Allen | 294/92 |
| 2,993,672 | 7/1961 | Bower et al. | 248/211 |
| 4,414,700 | 11/1983 | Burns | 15/105 |

*Primary Examiner*—Roscoe V. Parker

*Attorney, Agent, or Firm*—Schwartz, Jeffery, Schwaab, Mack, Blumenthal & Evans

[57] ABSTRACT

A multipurpose tool designed particularly for use while painting, and including a claw for opening large pails or buckets and a blade for scraping and for opening standard one gallon paint cans. The claw is designed to extend partially or entirely around the rung of a ladder thereby permitting the tool, and a supported paint can, to be suspended from the rung. The claw includes flanges for can support and for engaging under the bead of a pail or bucket for prying off the cover of the pail or bucket.

8 Claims, 5 Drawing Figures

MULTIPURPOSE TOOL

BACKGROUND OF THE INVENTION

The present invention relates as indicated to a multipurpose tool, and relates more particularly to a tool specifically designed to provide in one tool many of the necessary functions normally required when painting. For example, the tool is provided with a claw for opening relatively wide-lipped buckets, a blade at the front thereof for scraping and for opening conventional gallon cans of paint, and provides a stable hanger for suspending the tool, and a paint can, for example, to the rung of a ladder.

The prior art is literally replete with tools providing some but not all of the functions capable of being performed by the present invention. For example, U.S. Pat. Nos. 259,245; 376,825; 395,704; 429,515; 2,579,930 and 4,053,131 disclose various tools specifically designed to support a paint can from a supporting surface, typically the rung of a ladder. U.S. Pat. No. 3,363,316 discloses a tool having a blade at the front edge thereof specifically designed for removing wallpaper. U.S. Pat. No. 4,216,685, and U.S. Design Pat. Nos. 174,896; 263,198, and 276,304 illustrate various types of tools specifically designed for opening the lid of a pail or can.

While the tools illustrated in the noted patents satisfactorily perform the functions indicated, they do not commonly provide the flexibility or multifunction use provided by the tool of the present invention.

SUMMARY OF THE INVENTION

The tool constructed in accordance with the present invention is primarily designed for use by painters, and is able to perform numerous functions normally requiring the use of separate tools. The tool can be used to open large pails or buckets containing paint or other types of protective coatings, and conventional one gallon cans of paint. The tool includes a scraping blade for scraping surfaces where scale is to be removed prior to painting, and can be used to efficiently suspend a paint can or pail from the rung of a ladder. The tool is of high strength plastic, and is reinforced around the edges to enhance the indicated functions, and to ensure long life of the product.

The tool is particularly characterized by a claw portion having inwardly and upwardly turned flanges for gripping the outer bead of a pail for removing the same, and for engaging around the rung of a ladder for supporting a paint can from the rung in a very stable manner.

The scraping blade at the forward end of the tool additionally functions to provide a relatively wide, essentially blade surface to facilitate the removal of the top of a paint can in which the top is formed with an outer peripheral bead under which a blade can be inserted for prying up the bead for removing the cover. This type of lid construction is of the normal type provided with one gallon cans of paint.

The tool is preferably constructed from high impact styrene by injection molding, with the blade being embedded at the front of the tool during the molding process. The high impact styrene provides a high density and consequent toughness to the tool to withstand repeated uses and provide a long life for the product. The tool is reinforced around its edges by laterally extending beads, particularly effective in increasing the strength of the tool in the claw area, and the tool is formed with a gripping surface on its under side to enhance the gripping and use of the tool.

These and other objects of the invention will be apparent as the following description proceeds in particular reference to the application drawings.

BRIEF DESCRIPTION OF THE APPLICATION DRAWINGS

DETAILED DESCRIPTION OF THE PREFERRED EMBODIMENTS

Figure 2:
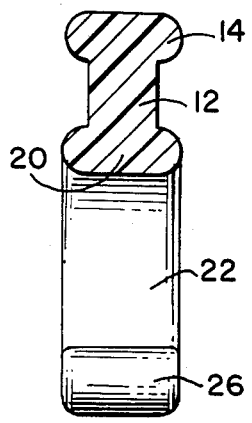
FIG. 2 is a sectional view taken on line 2—2 of FIG. 1.

The tool is generally indicated at 10 and includes a body portion 12 of uniform thickness throughout the length of the tool. The thickness of the tool is increased preferably along all edges by providing a laterally extending continuous bead 14 which serves to reinforce and strengthen the tool throughout its length. The thickness of the bead relative to the thickness of the body portion 12 can be seen in FIG. 2.

Figure 5:
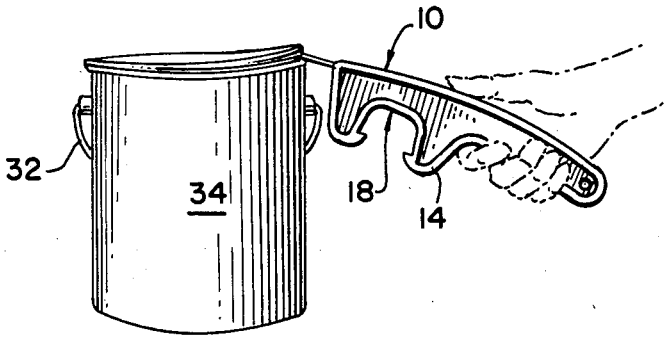
FIG. 5 is a perspective view showing the manner in which the front blade can be utilized to open and remove the lid or cover of a conventional paint can.

A blade 16 is embedded in the front of the tool in the beaded area of greater thickness, with the width of the blade being such that the blade can serve as a scraper, and can also be used to open paint cans, as shown in FIG. 5.

Figure 3:
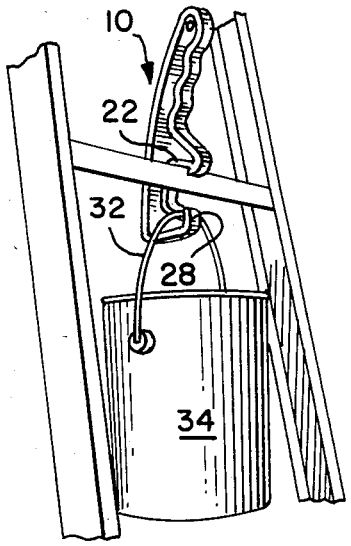
FIG. 3 is a perspective view showing the manner in which the tool can be utilized to support a paint can from the rung of a ladder.
Figure 4:
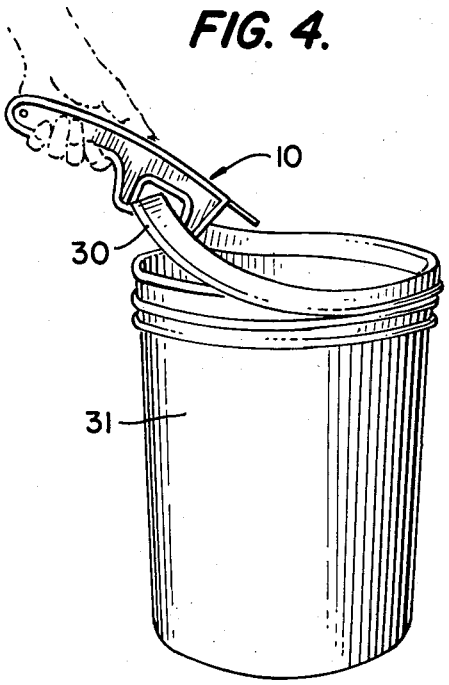
FIG. 4 is a perspective view illustrating the manner in which the tool is used to remove the beaded cover from a bucket or pail.

Relatively adjacent the front of the tool, the body portion is upwardly relieved to form a claw generally designated at 18 comprising a bottom wall 20 and side walls 22 and 24, with the claw being generally inverted U-shape in cross section. The edges of the walls are likewise formed with beads 14 for rigidifying the claw. Inwardly and upwardly directed flanges 26 and 28 are provided at the ends of the side walls 22 and 24, respectively, with the flanges performing several functions. Referring to FIG. 4, the flange 26 is shaped so as to fit tightly under the outer bead 30 of the lid of a large bucket or pail 31, with the bottom of the opposite flange 28 engaging the upper surface of the pail cover and serving as a fulcrum about which the cover can be pried open as shown in FIG. 4. Secondly, the flange 26 is adapted to fit partially or entirely around the rung of a ladder, with the rung engaging the side wall 22 as shown in FIG. 3. If the diameter of the rung exceeds the length of the wall 26, the end of the flange 26 will engage the peripheral surface of the rung, which is normally longitudinally grooved. Such engagement coupled with the weight of the can to be suspended provides a stable holding arrangement. The flange 26 prevents the tool from slipping from the rung, and the inclination of the flange 28 serves to provide a cradling area for the bail or handle 32 of a paint can 34, as shown in FIG. 3.

As previously noted, the tool is preferably made of high impact styrene so as to give the tool the desired strength and toughness. The tool can be made by injection molding, with the blade 16 being embedded during the molding process. Ridges commonly designated at 38 and intervening depressions commonly designated at 40 are molded in the tool in the handle area so as to provide a gripping surface to enhance manipulation of the tool. An opening 42 near the end of the tool extends entirely through the thickness of the body 12 to provide a means by which the tool can be hung during nonuse.

The dimensions of the tool can vary considerably. Highly satisfactory results have been obtained where the body portion of the tool is approximately 0.35–0.6" in thickness and the reinforcing beads are 0.15–0.3" in lateral thickness. The bottom wall 20 of the claw is 1.5–2.0" long, and the side walls 22 and 24 are approximately 0.8 to 1.2" long. The wall 22 is slightly inclined (10°–20°) relative to a transverse vertical plane centrally through the bottom wall 20, and the wall 26 is more inclined (20°–35°) relative to the same plane. The length and inclination of wall 22 are designed so that the tool hangs generally vertically when supporting a pail as shown in FIG. 3.

Figure 1:
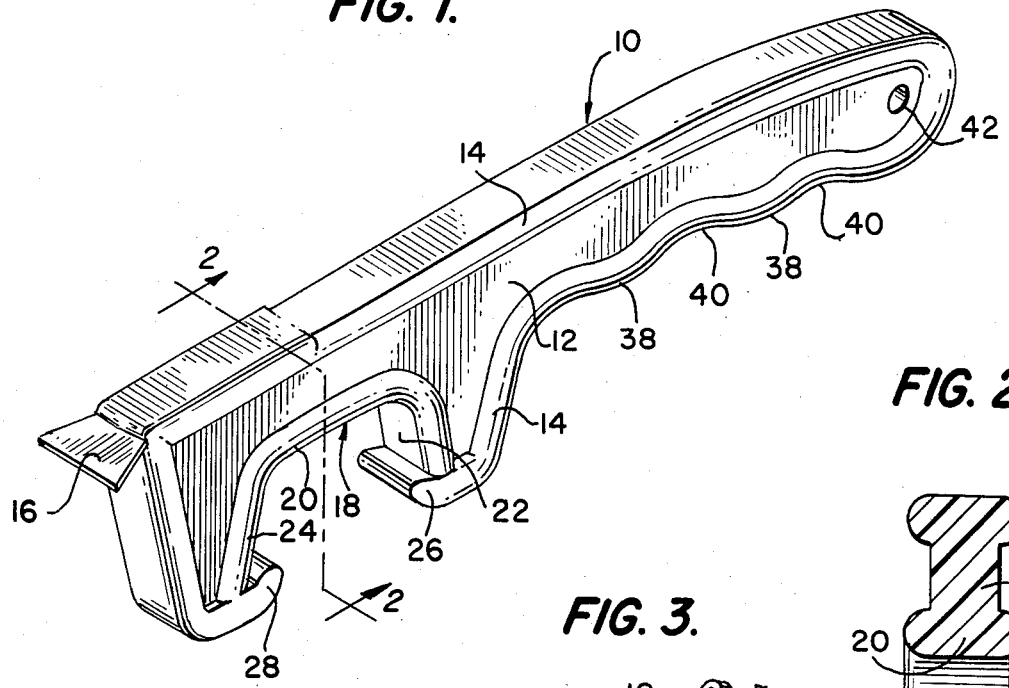
FIG. 1 is a perspective view of the tool constructed in accordance with the present invention.

The faces of the flanges 26 and 28 are inclined upwardly approximately 15°–45° relative to the horizontal. This permits the flange 26 to more effectively engage and lift the bottom of the cover bead 30. Moreover, the shape of the flange 26 in combination with the length of the wall 22 permits the tool to be used with virtually all large pails or buckets currently on the market. Although not clearly visible in FIG. 1, the wall 22 and flange 26 are approximately 0.20–0.35" longer than wall 24 and flange 28 so as to position the flange 26 below the cover bead of the pail to provide maximum leverage. When in a position to open the cover, the tool is accordingly generally horizontal, with the bottom of flange 26 resting on the top surface of the pail to provide a fulcrum point.

The tool shown in the application drawing is specifically designed for ladders having round rungs. For step ladders having flat rungs, the tool can conveniently be suspended from the ladder hinge for supporting the can handle.

What is claimed:

1. A multipurpose tool, comprising (a) a body portion, (b) reinforcing beads extending laterally from the body portion for reinforcing the tool, (c) a claw comprised of a bottom wall and inclined side walls, with at least one of said side walls being of a length to extend over the rung of a ladder, (d) flanges at the outer ends of said side walls extending inwardly and upwardly toward the bottom wall of said claw, the flange adjoining said one side wall being adapted to impinge upon or extend around the ladder rung when the tool is so oriented, and the opposed flange adapted to receive and cradle the handle of a paint can so as to suspend said can from said ladder rung, (e) said claw and flanges being reinforced with said beads, and (f) a scraper blade embedded in said tool at the forward end thereof.

2. The tool of claim 1 wherein said tool is formed of high impact styrene.

3. The tool of claim 2 wherein said body portion is 0.3–0.6" in thickness and said reinforcing beads are 0.15–0.3" in lateral thickness.

4. The tool of claim 1 wherein said beads extend continuously around the edges of said tool.

5. The tool of claim 1 wherein said flanges extend upwardly at an angle of 15°–45° relative to the horizontal.

6. The tool of claim 1 wherein ridges and depressions are formed in the bottom wall of said tool rearwardly of said claw so as to provide a finger gripping surface.

7. The tool of claim 1 wherein said side walls are inclined 10°–35° relative to a vertical transverse plane through the center of the bottom wall of the claw.

8. The tool of claim 1 wherein said one side wall and its associated flange are approximately 0.20–0.35" longer than the opposed side wall and the flange, thereby permitting the flange of said one side wall to be positioned below the bead of the cover of a pail or bucket and the tool oriented generally horizontally.

* * * * *